US005250849A

United States Patent [19]

Periou

[11] Patent Number: 5,250,849

[45] Date of Patent: Oct. 5, 1993

[54] DEVICE FOR MONITORING THE CLOSURE OF THE OPENING POINTS OF A MOTOR VEHICLE

[75] Inventor: Pierre Periou, Cergy Pontoise, France

[73] Assignee: Rockwell Automotive Body Systems, France

[21] Appl. No.: 709,938

[22] Filed: Jun. 4, 1991

[30] Foreign Application Priority Data

Jun. 5, 1990 [FR] France ..... 90 06936

[51] Int. Cl.[5] ..... E05B 47/00

[52] U.S. Cl. ..... 307/10.1; 307/10.2; 180/289; 70/257; 70/264

[58] Field of Search ..... 307/10.1-10.5, 307/116, 130; 340/426-430, 825.31, 825.32, 825.34, 438, 457, 644, 686; 116/12, 28 R, 86; 180/286, 287, 289; 361/171, 172, 187; 70/237, 256, 257, 264

[56] References Cited

U.S. PATENT DOCUMENTS 3,975,708 8/1976 Lusk et al. ..... 340/438

*Primary Examiner*—Jeffrey A. Gaffin

[57] ABSTRACT

The invention relates to a device for monitoring the closure of the opening points of a motor vehicle, in which each opening point is equipped with a closure contact which is connected to a central unit. It is characterized in that the central unit is connected to all the opening points by a single common line (8) with two conductors (31, 32), in that the central unit comprises at least one periodic-signal generator (28) connected to the said two conductors, in that each opening point comprises a passive receiver circuit tuned to the frequency of the periodic signal supplied by the said generator (28) of the central unit, the said passive circuit being connected in series with the closure contact of the said opening point, and in that the said device comprises, furthermore, indicia of a closure fault in response to the variations of the signal generated by the generator in response to the actuation of the corresponding closure contact.

1 Claim, 4 Drawing Sheets

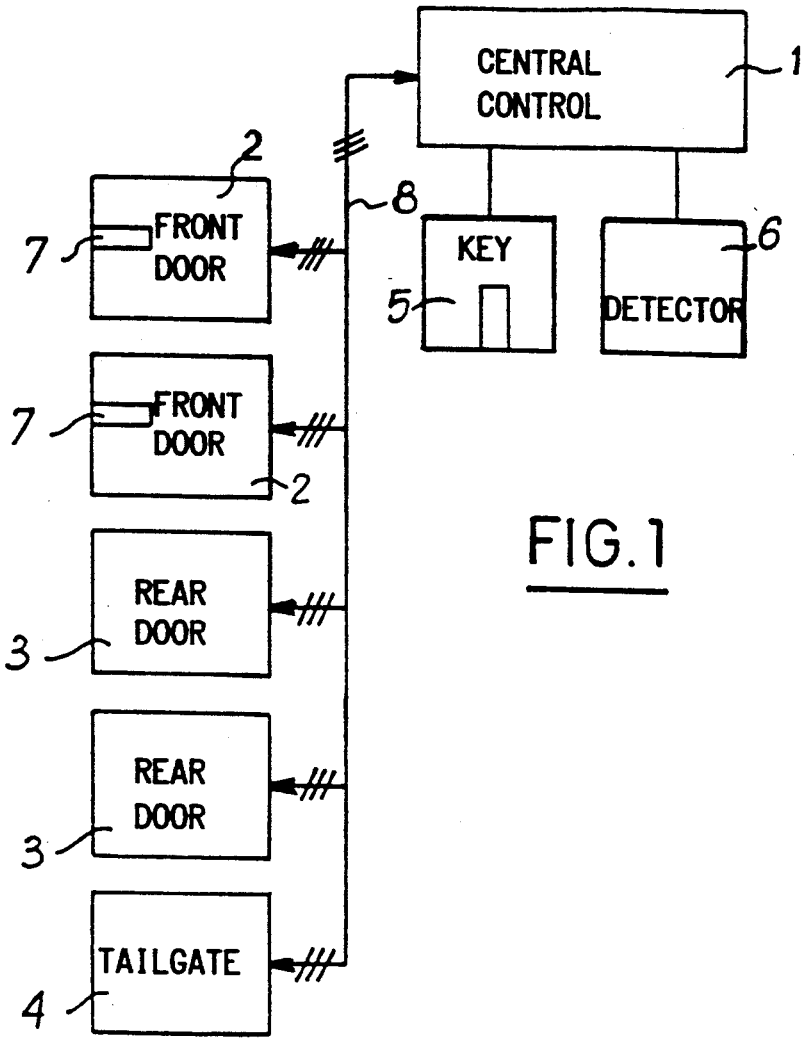
FIG. 1
FIG. 2
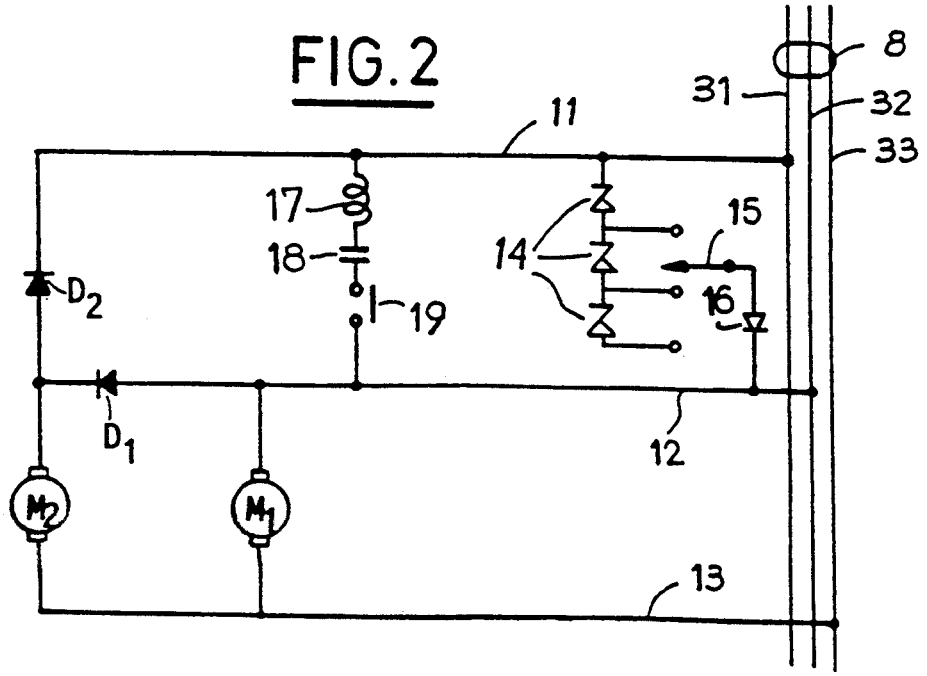

DEVICE FOR MONITORING THE CLOSURE OF THE OPENING POINTS OF A MOTOR VEHICLE

BACKGROUND OF THE INVENTION

1. Field of the Invention

The present invention relates to a device for monitoring the closure of the opening points of a motor vehicle. It is intended for monitoring the state of closure of the locks of doors, the trunk and other protected-access devices, such as the petrol flap, glove box, etc.

2. Description of the Related Art

At the present time, a closure contact is associated with each of the opening points to be monitored, and when this opening point is open or improperly closed this closure contact is actuated and sends a signal to a central unit which is arranged on the dashboard and which comprises visual-alarm devices, each associated with an opening point, in such a way that, when ignition contact is made, the driver is warned that, for example, a door is improperly closed.

This monitoring device requires a line for each opening point monitored, in order to send the above-mentioned signal to the central unit; the result of this is that the latter receives a line for each opening point monitored; this line can be bifilar or can comprise only a single wire if the return is made via earth. At all events, the monitoring of the state of closure of the opening points requires the wiring of a line between each of the accesses and the central unit which can therefore receive, for example, five or six conductors, each corresponding to an opening point.

Now the operations for the electrical wiring of a motor vehicle are difficult and continue to be expensive.

The object of the invention is, therefore, to provide a device for monitoring the closure of the opening points of a motor vehicle which makes it possible to reduce the number of conductors necessary for the connection between the opening points and the central monitoring unit and also to reduce the total length of the conductors used.

SUMMARY OF THE INVENTION

The subject of the invention is a device for monitoring the closure of the opening points of a motor vehicle, in which each opening point is equipped with a closure contact which is connected to a central unit, characterised in that the central unit is connected to all the opening points by means of a single common line with two conductors, in that the central unit comprises at least one periodic-signal generator connected to the said two conductors, in that each opening point comprises a passive receiver circuit tuned to the frequency of the periodic signal supplied by the said generator of the central unit, the said passive circuit being connected in series with the closure contact of the said opening point, and in that the said device comprises, furthermore, means for signalling a closure fault which are sensitive to the variations of the signal generated by the generator in response to the actuation of the corresponding closure contact.

According to one embodiment of the invention, the central unit comprises a single generator and the passive circuit consists of a vibrator; this vibrator can have a time delay, and in this case the central unit comprises a visual-alarm device.

According to another embodiment of the inventions, each opening point comprises a series resonant circuit connected between the said conductors, the resonant frequency of the said resonant circuit being specific to each opening point, the central unit comprises trap circuits connected to one of the said conductors, each trap circuit being associated with an opening point and being tuned to the resonant frequency of the resonant circuit of the said opening point, and the central unit comprises a generator supplying signals at the various resonant frequencies of the above-mentioned resonant-circuit/trap-circuit pairs.

The invention will be better understood from the following description given solely by way of example and made with reference to the accompanying drawings in which:

BRIEF DESCRIPTION OF THE DRAWINGS

FIG. 1 is a block diagram of an embodiment of the invention;

FIG. 2 is a diagram of the circuit located in a front opening point;

DETAILED DESCRIPTION OF THE PREFERRED EMBODIMENT

Figure 3:
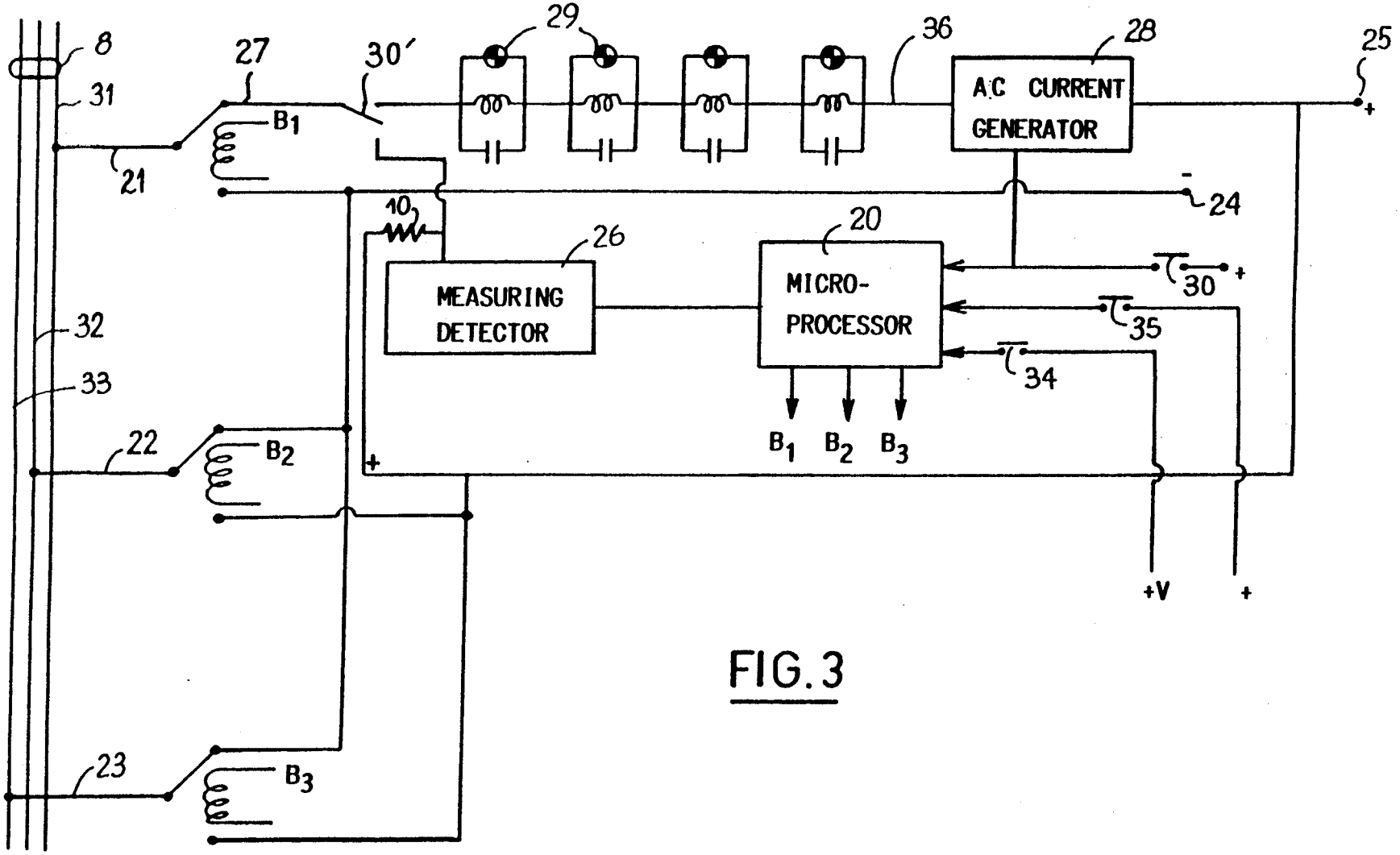
FIG. 3 is a block diagram of the central control unit.

FIG. 1 is a general block diagram of a device according to the invention, which essentially comprises a central control unit 1 intended for controlling the "desecuring", "securing", or "supersecuring" of opening points, such as front doors 2, rear doors 3 and a tailgate 4. A central control unit can receive commands provided by the mechanism of the ignition key 5, by a remote-control receiver 6 or by an anti-attack button.

The two front doors 2 are equipped with a key lock 7 which is fitted with electrical contacts supplying electrical signals to the central control unit 1 for the purpose of "desecuring", "securing" or "supersecuring" the opening points.

The structure of the various elements of this diagram is such that the connection between the central control unit 1 and the various opening points is made simply by means of a line 8 with three conductors 31, 32, 33 which constitutes a kind of bus junction between the central control unit 1 and the opening points, each of these being connected in parallel to the line 8.

FIG. 2 is an electrical diagram of the circuit contained in an opening point, such as a front door. This circuit comprises essentially three conductors 11, 12, 13, each connected to one of the conductors of the line 8 (the key control can take place, for example, between 11 and 12).

Each opening point comprises a triple-effect electrical actuator, for example two direct-current motors M1 and M2; the motor M1 controls the "securing" or "desecuring" of the opening point and the motor M2 controls the "supersecuring" or "desecuring" of the lock. In the "supersecuring" position, the door cannot be opened by using the mechanical control elements of the door, namely a lever or pusher, but only by an electrical command provided as a result of the insertion of a coded key into the lock 7 or by a remote command received by the detector 6.

According to the invention, for each actuator, the motors M1 and M2 are connected permanently between the three conductors 11, 12 and 13. In the example illustrated, the motor M1 is connected between the conductor 13 and the conductor 12. The second motor M2 is likewise connected between the conductors 13 and 12. On this conductor 12, a diode D1 separates the terminals of the motors M1 and M2, the cathode of D1 being connected to M2. Moreover, the terminal of M2 joined to the conductor 12 is extended on the conductor 11 by a diode D2, the cathode of which is connected to this conductor 11. The control takes place between the conductors 11 and 12. Branched off from the conductor 11 is an assembly of three electronic components, in the example illustrated Zener diodes 14 connected in series. From the anodes of these Zener diodes, three terminals are defined for a switch.

The other conductor 12 is connected to the common terminal of a three-position switch 15 by means of a diode 16, the cathode of which is connected to the conductor 12. The function of the diode 16 is to prevent a power current from passing through the Zener diodes if a key request occurs during a power transfer for "super-securing". This three-position switch consists, in fact, of the coded key inserted in the lock 7; the three possible positions of the lock key 15 correspond to the abovementioned three states, namely "desecuring", "securing" and "supersecuring". This switch closes a circuit via one or more Zener diodes according to the particular request.

Finally, a resonant circuit consisting of a coil 17 and a capacitor 18 is connected between the two conductors 11 and 12, with the interposition of a contact 19 which corresponds to the open-door contactor O.D.C. and which is closed when the door is open or improperly closed.

The electrical circuit integrated in the other opening points, such as the rear doors or the tailgate, does not include the elements 14 to 16 corresponding to the key lock 7.

FIG. 3 shows the circuit of the central control unit in simplified form. The line 8 is connected to three inputs 21, 22 and 23 which correspond respectively to the conductors 11, 12 and 13 of each of the opening points. Each of these inputs is connected to the contact of a respective control relay B1, B2 and B3, these being shown in the state of rest. The coils of the relays B1, B2 and B3 are controlled by a microprocessor 20, as will be described in detail later. In the state of rest corresponding to the vehicle left unattended, the terminal 23 corresponding to the conductor 33 of the line 8 and the terminal 22 corresponding to the conductor 32 of the line 8 are connected to the negative terminal 24 of the supply battery of the vehicle. When the relays B2 and B3 are energised into the working position, the terminals 22 and 23 are connected to the positive terminal 25 of the vehicle battery.

When the relay B1 is energised, the terminal 21 corresponding to the conductor 31 of the line 8 is connected to the negative terminal 24 of the battery. In the position of rest, the terminal 21 is connected to a measuring detector 26 which supplies information to the microprocessor 20. This terminal 21 is biased at the positive voltage by a resistor 10 which is connected to the conductor 21 by means of the break contact 27 of the relay B1 and of the make contact of a switch 30' controlled as a result of the actuation of the ignition key.

Moreover, when the vehicle is being used, with the ignition key inserted, the break contact 27 of the relay B1 can also be connected to an alternating-current generator 28 either by means of trap circuits connected in series or by means of a resistor, in which case the string of trap circuits can be connected in parallel between 12 and 13 or omitted. Each of these trap circuits tuned to the resonant frequency of the resonant circuit 17, 18 of one of the opening points. An alarm device, such as an indicator lamp 29, is connected in parallel to each of the resonant circuits. This indicator lamp can consist, for example, of a light-emitting diode.

The putting into operation of the generator 28 is controlled by a signal occurring as a result of the closure of a contact 30 which is closed by the ignition key of the vehicle and which corresponds to the circuit 5 of FIG. 1.

The microprocessor 20 also receives information from the contact 30 on the insertion of the ignition key of the vehicle. It also receives information by means of an anti-attack contact 34 which can be closed by the user when he is in the vehicle. Finally, the microprocessor 20 receives a "securing", "supersecuring" or "desecuring," command provided by means of a contact 35 associated with the remote-control detector 6.

Figure 4:
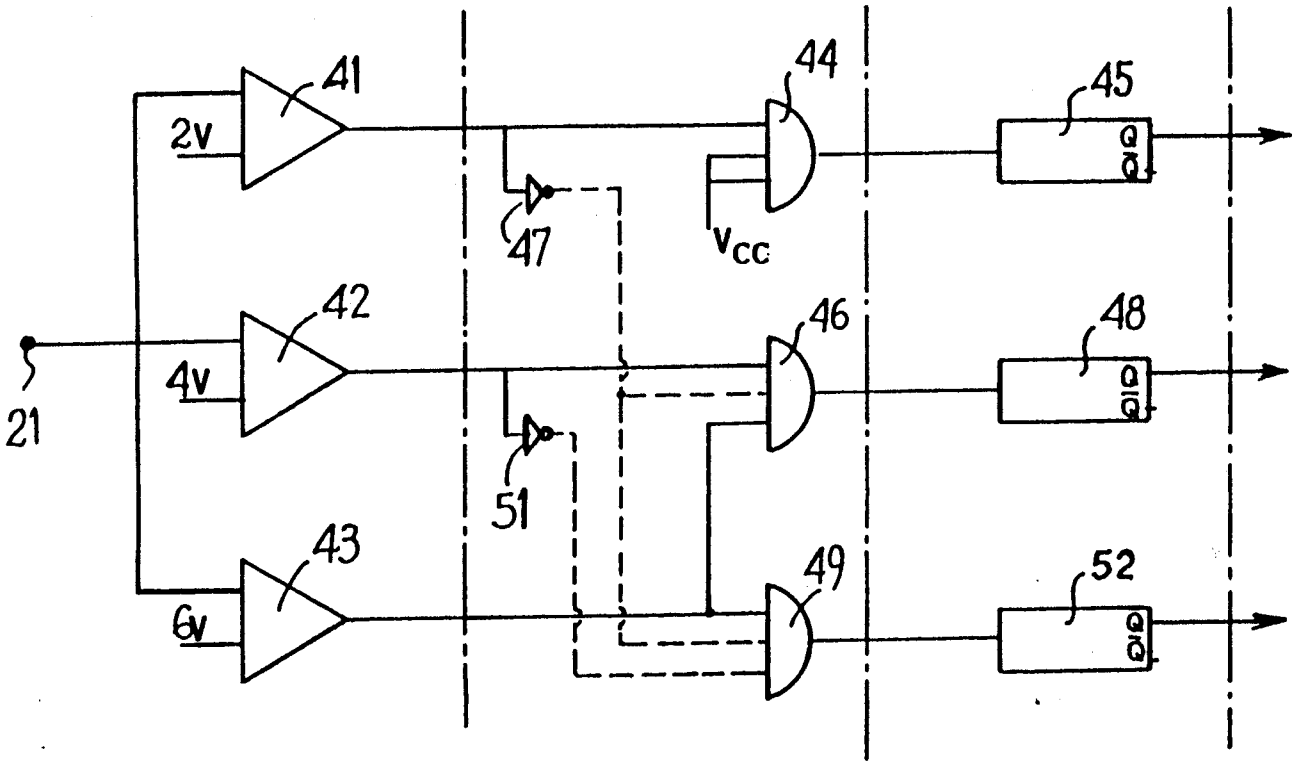
FIGS. 4 and 5 are detailed diagrams of the central control unit.

FIG. 4 is a detailed diagram representing the detector circuit 26. The signal coming from the measuring conductor 31 is sent to three operational amplifiers 41, 42 and 43 which, on the other hand, each receives a nominal value matched to the voltages of the Zener diodes 14.

In the example illustrated, these reference signals are respectively equally to 2, 4 and 6 volts. The signal supplied by the first operational amplifier 41 is sent to an AND gate 44 with three inputs, the other two inputs of which receive a positive voltage corresponding to the logical state 1. The output of the logical AND gate 44 is sent to a monostable multivibrator 45, the output of which supplies a first command signal.

The output of the second operational amplifier is sent to a logical AND circuit 46 with three inputs; the second input of this circuit receives the output signal from the operational amplifier 43 and the third input of this circuit receives the inverted output signal from the comparator 41, the inversion being carried out by an inverting gate 47. The output of this logical AND circuit 46 controls the second monostable multivibrator 48, the output of which likewise supplies a command signal.

The output of the operational amplifier 43 is sent to a logical AND circuit 49 with three inputs, the other three inputs of which receive respectively the inverted output signal of the operational amplifier 41 and the inverted output signal of the operational amplifier 42 by means of an inverting gate 51. The output of the logical AND circuit 49 controls a third monostable multivibrator 52, the output of which likewise supplies a command signal.

Figure 6:
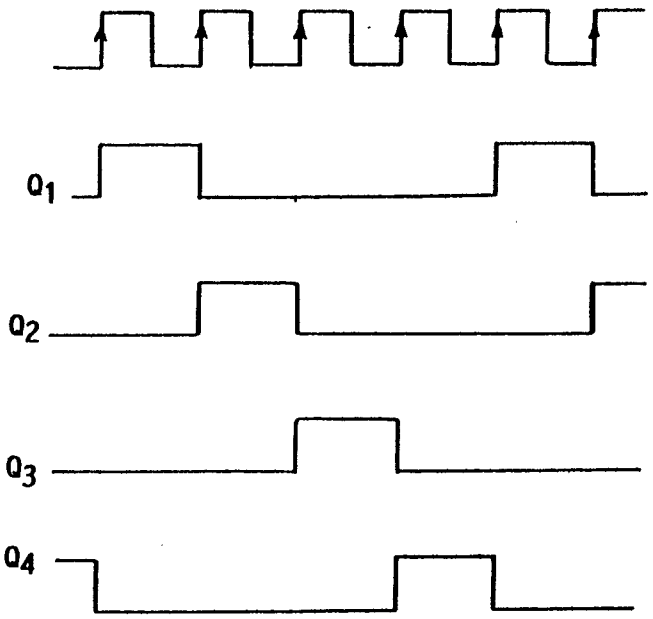
FIG. 6 is a graph explaining FIG. 5.
Figure 5:
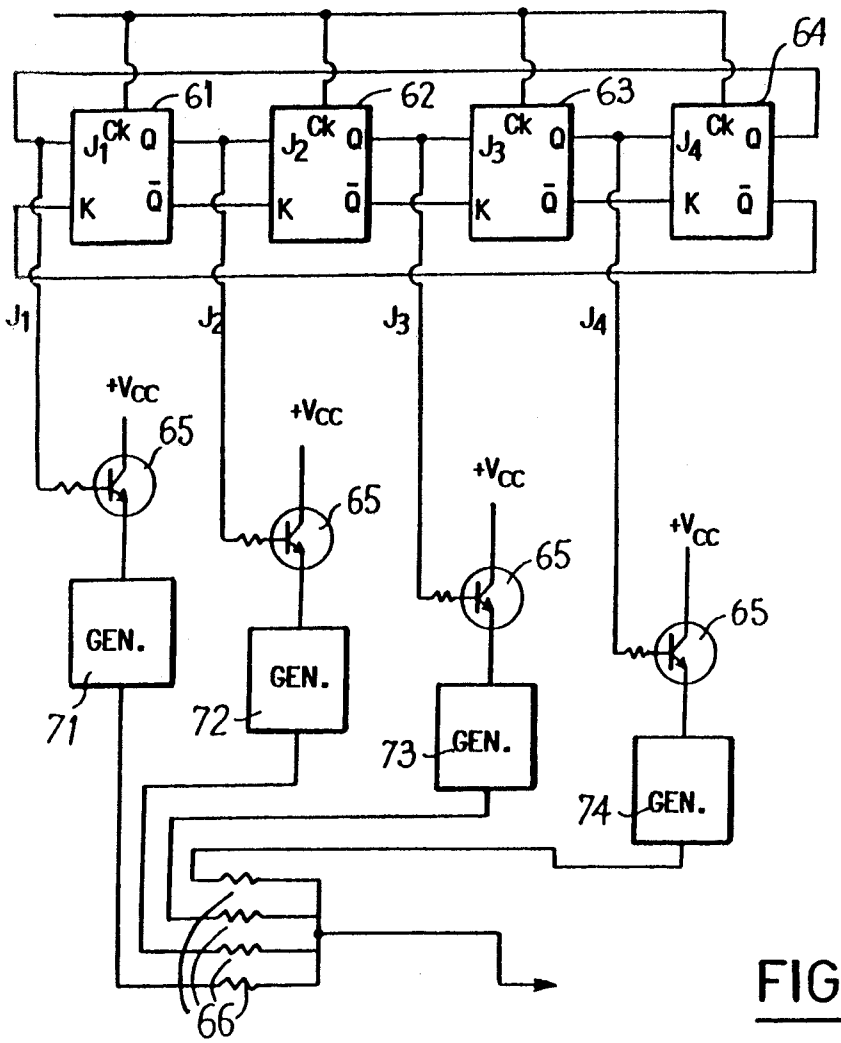

FIG. 5 is a diagram showing the generator 28 in detail. It consists essentially of four multi-vibrators 61, 62, 63 and 64 which are connected in series so as to form a ring counter; FIG. 6 is a timing diagram respectively representing the clock signal sent to each of the multivibrators and their output Q.

The output signal Q of each of the multivibrators controls a transistor 65 which forms a switch arranged between the direct-voltage source and the feed wire of each periodic-signal generator 71, 72, 73 and 74. The output of each of these generators is sent to the conductor 36 of FIG. 3 upstream of the trap circuits.

The frequencies of the signals supplied by generators 71 to 74 correspond respectively to the resonant frequencies of each of the resonant circuit assemblies 17, 18 of the gate circuit and corresponding trap circuit of the central control unit.

The device which has just been described functions as follows. When the door key is inserted into the lock 7, this key can assume the three positions of the switch 15. The voltage of the Zener diodes 14 is selected so as to be slightly below the triggering threshold of the comparators 41 to 43; thus, if a Zener voltage slightly below 2 volts is selected, the triggering of the comparators 41, 42 and 43 will be obtained when only one of the Zener diodes 14 is connected by the switch 15, the triggering of the comparators 41, 42 and 43 will be obtained when only one of the Zener diodes 14 is connected by the switch 15, the triggering of the comparators 42 and 43 when two diodes are connected and the triggering of the comparator 43 when the three Zener diodes 14 are connected by the switch 15.

In the absence of a request by the key in the lock 7, the voltage read off by the detector 26 is the battery voltage which is sent from the terminal 25 via the resistor 10.

If this voltage is higher than the maximum threshold of 6V, none of the comparators 41 to 43 changes from the logical value "0" to the logical value "1". No command is sent to the coils of the relays B1, B2 and B3. If the key is inserted into the lock 7 and actuated in the "desecuring" direction, the contact corresponds to the connection of the three Zener diodes 14 in series and only the comparator 43 supplies a logical "1" at its output, thereby unblocking the logical AND gate 49 which changes to 1 and which activates the multivibrator 52 which provides a command for activating the coil of the relay B2. The effect of this is to apply the positive supply voltage to the conductor 32 of the bundle 8 and consequently to the control line 12. The motor M1 and the motor M2 by means of the diode D1 are then fed in the "desecuring" direction in each of the doors controlled by the central control unit.

If the door key is actuated in the "securing" direction, there are two positions, the first corresponding to the normal "securing" of the doors and the second two "supersecuring". These two positions can be two successive positions of the key or the second position can correspond to keeping the key in the "securing" position for a given time.

If the door key is actuated to obtain "securing", the position corresponding to two diodes 14 in series is obtained and the two comparators 42 and 43 change to the logical state "1"; the inverter 51 blocks the AND gate 49 and only the gate 46 changes to the logical state "1", thereby activating the multivibrator 48 which controls the supply to the coil of the relay B3. The result of this is that the motor M1 is fed in the opposite direction to the "desecuring" direction. The motor M2 is not actuated because its two terminals are connected to the same positive supply potential and D1 opposes the passage of the current towards 32.

Finally, if the key changes to the "super-securing" position, only the first zener diode 14 is connected to the measuring circuit and the comparators 41, 42, 43 change to the logical state "1". The output of the comparator 41 blocks the gates 46 and 49 by means of the inverting circuits 47 and 51. The result of this is that only the gate 44 is unblocked, thereby actuating the multivibrator 45 which controls the supply to the coil of the relays B1 and B3. In this case, the positive voltage is applied to the conductor 13, the other conductors being connected to the negative terminal; the motor M1 is actuated in the "securing" direction and the motor M2 is likewise actuated in the "securing" direction, the assembly as a whole constituting "supersecuring".

The diodes D1 and D2 make it possible to isolate or select M2 according to the pluralities applied to the three conductors, this allowing it to be put at rest in the event of a simple "securing" request where M1 alone is activated.

Should there be two simultaneous key requests, the lowest Zener voltage has priority, thus determining priority in the event of two simultaneous different key requests. In the example given, the "supersecuring" request corresponding to the lowest Zener voltage has priority over the other commands. The same is true of the "securing" command which has priority over a "desecuring" command. This is a choice which can be changed as desired. This and protections on the monostable multivibrators prevent the transmission of two simultaneous different commands.

The Zener diodes 14 can be replaced by other electronic components dividing a voltage applied to the terminals of the two conductors. It will be possible, for example, to use three resistors of different values connected in parallel between the conductor 11 and the moveable contact of the switch 15, each resistor forming a voltage divider bridge with the resistor 10, the free ends of the resistors constituting three contact studs of the switch.

The microprocessor 20 can also be controlled by means of the remote control represented diagrammatically by the contact 35 which supplies "desecuring" or "securing" information to the microprocessor 20.

The device according to the invention also comprises an anti-attack device represented diagrammatically by the contact 34 which is actuated by the occupant of the vehicle when he is inside and which likewise transmits "securing" command information to the microprocessor 20.

The microprocessor 20 also receives information relating to the ignition key of the vehicle (contact 30). The information provided as a result of the actuation of the ignition key of the vehicle allows the actuation of the anti-attack device and inhibits the remote control. Furthermore, the actuation of the vehicle ignition key controls the monitoring procedure for the door contacts by activating the generator 28 which therefore operates only when the ignition key is in the active position. This position cancels the positive direct voltage applied to the control conductor 21 which is thus subjected to the periodic signals supplied by the generator 28.

Should a door "securing" or "desecuring" command be transmitted during this monitoring as a result of the actuation of the anti-attack device, the monitoring is interrupted for a brief moment by the microprocessor 20 so as to execute the command.

The monitoring of the state of closure of the doors is carried out by using two conductors only, namely the conductors 31 and 32.

As can be seen by referring to FIGS. 5 and 6, the generator supplies a train of pulses of different frequencies which correspond respectively to the resonant frequencies of the resonant-circuit/trap-circuit pairs of the central control unit and of each door.

If one of the door contacts 19 is closed, the current circulates via the two conductors 11 and 12, there is a drop of impedance of the resonant circuit to the resonant frequency of the door in question, and the result of this is that the voltage of the terminals of the corresponding trap circuit of the central control unit assumes a high value, thereby actuating the alarm consisting, for example, of the indicator lamp 29 which flashes at the cyclic frequency of the generator 28.

According to another em t of the invention, the generator 28 supplies a complex voltage comprising a plurality of equal voltages, the frequencies of which correspond to the frequencies of the resonant circuits. In this case, a summing circuit can be used to send all the frequencies to the conductor 11. In this instance, the four signal generators are fed continuously and the ring counter is no longer used.

It can be seen that, when the vehicle is at a standstill (ignition contact not made), a positive voltage is applied to the control conductor 11, 21, 31, and even if a door is improperly closed, with the contact 19 closed, no current will circulate in the two control conductors 11 and 12 because the capacitor of the resonant circuit of the improperly closed door forms a direct-current switch.

According to another embodiment of the invention, single-frequency generator is provided in the central control unit only, and in each door the series resonant circuit is replaced by a vibrator operating at the frequency supplied by the generator of the central control unit.

This embodiment makes it possible to limit the space required on the dashboard by numerous indicator lamps. However, a single indicator lamp constituting a permanent alarm can be provided, whilst the operation of the vibrator has a time delay and the sound signal ceases after a particular time.

To prevent current consumption when ignition contact is not made and a positive direct voltage is sent to the first control conductor 11, a capacitor can be arranged in series with each of the vibrators. Since the indicator of an improperly closed door is in the door itself, the attention of the occupants is drawn to it much more quickly, above all where rear doors are concerned.

According to another embodiment of the invention, the trap circuits are omitted and the generator 28 permanently sends trains of periodic waves of different frequencies cyclically. These signals pass through a resistor arranged in series with the generator 28 in the central unit. Together with the impedance of the resonant circuits, this resistor performs the function of a voltage divider bridge; the amplitude of each of the signals passing through it can be seen at its terminal adjacent to the conductor 21. In the absence of an improperly closed door, the amplitude of the signal at the abovementioned terminal is that of the signal transmitted by the generator 28. As soon as the door contact 19 closes, this amplitude drops in the manner of a voltage divider bridge for the signal to the resonant frequency of the improperly closed door. An alarm is triggered as soon as this variation in voltage amplitude is detected. Since any signal at a given frequency is transmitted periodically for $\frac{1}{4}$ of a period as a result of the feeding of the system by the ring counter (see FIG. 5), in the event of a voltage drop it is known exactly which door is involved since a door is sensitive to its natural frequency and not to the other frequencies transmitted for the other doors during the remaining $\frac{3}{4}$ of a period. The period is divided into as many portions as there are doors to be monitored (4 here in the example given).

According to another embodiment of the invention, it is also possible to arrange the series of trap circuits in parallel between the two conductors 21 and 22 in the central unit, that is to say between the output 36 of the generator connected to the conductor 21 and the negative polarity of the battery connected to the conductor 22. The generator 28 permanently sends the trains of periodic waves at the different frequencies cyclically by way of a resistor. When its natural frequency is received, each trap circuit has a high impedance. As soon as the door contact 19 of the corresponding resonant circuit is closed, the impedance of the terminals of the said trap circuit drops, and the same is true of the voltage at its terminals. An alarm is triggered as soon as this voltage drop is detected.

It can be seen that the invention, by using only three connecting conductors forming a bus between the central control unit and each of the opening points, makes it possible to control in a centralised manner the opening, "securing" and even a "supersecuring" of the doors and to send from each of the doors the necessary commands provided by the door key.

Another advantage of the invention is that only passive elements are accommodated in the doors, this being important from the point of view of cost and reliability.

Moreover, two of these conductors are sufficient to carry out the monitoring of the state of closure of all the opening points, with the improperly closed door indicated each time.

The invention also applies to opening points comprising a double-effect actuator, such as opening points without "supersecuring" (luggage boot, petrol flap, etc.). In this case, if the actuator is a reversible motor, it will be connected permanently between two conductors.

We claim:

1. Device for the centralized control and monitoring of opening points (2, 3, 4) of a motor vehicle in which the opening points have electrical motors (M1, M2) and a closure contact which are connected by means of a single common line (8) having three conductors (31, 32, 33) to a central control unit, the central control unit (1) comprises at least one periodic signal generator connected to conductors (31, 32) and each opening point (2 through 4) comprises a passive receiver in unit (17, 18) tuned to the frequency of the periodic signal supplied by the generator (28) of the central unit (1), the passive circuit being connected in series with the closure contact (19) of the opening point, the device comprises means for signaling a closure fault which is sensitive to the variations of the signal generated by the generator in response to the actuation of the corresponding closure contact (19) and first motor (M1) connected between two conductors (12, 13) of the line (8) and a second motor (M2) connected directly to one of said two conductors (12, 13) and connected to the other of these conductors through a first diode (D1), the cathode of which is connected to the said second motor, and a second diode (D2) is connected between the terminal of the second motor (M2) and said third conductor (11) of the line (8), the anode of this second diode being connected to the second motor (M2).

* * * * *